US010633912B2

(12) United States Patent
Baitz et al.

(10) Patent No.: US 10,633,912 B2
(45) Date of Patent: Apr. 28, 2020

(54) DEVICE FOR HANDLING NOTES OF VALUE COMPRISING AN INTERMEDIATE MODULE ADAPTABLE TO THE THICKNESS OF THE SAFE WALL

(71) Applicant: Wincor Nixdorf International GmbH, Paderborn (DE)

(72) Inventors: Günter Baitz, Berlin (DE); Thomas Blechert, Berlin (DE)

(73) Assignee: Wincor Nixdorf International GmbH, Paderborn (DE)

( * ) Notice: Subject to any disclaimer, the term of this patent is extended or adjusted under 35 U.S.C. 154(b) by 94 days.

(21) Appl. No.: 14/596,534

(22) Filed: Jan. 14, 2015

(65) Prior Publication Data

US 2015/0197977 A1 Jul. 16, 2015

(30) Foreign Application Priority Data

Jan. 16, 2014 (EP) ..... 14151459

(51) Int. Cl.

| | |
|---|---|
| ***G07D 11/125*** | (2019.01) |
| ***E05G 1/06*** | (2006.01) |
| ***E05G 1/02*** | (2006.01) |
| ***B65H 7/02*** | (2006.01) |
| ***B65H 7/20*** | (2006.01) |
| ***B65H 5/06*** | (2006.01) |

(Continued)

(52) U.S. Cl.

CPC ..... *E05G 1/06* (2013.01); *B65H 5/06* (2013.01); *B65H 7/02* (2013.01); *B65H 7/20* (2013.01); *E05G 1/02* (2013.01); *G07D 11/125* (2019.01); *G07D 11/18* (2019.01); *G07D 11/40* (2019.01); *G07D 11/50* (2019.01); *G07F 19/205* (2013.01)

(58) Field of Classification Search

CPC ..... G07D 7/00; G07D 11/125; G07D 11/18; G07D 11/50; G07D 11/40; E05G 1/06; E05G 1/02; G07F 19/205; G07F 19/00; G07F 1/00; B65H 5/06; B65H 7/20; B65H 7/02

USPC ..... 194/206, 207; 235/379; 209/534

See application file for complete search history.

(56) References Cited

U.S. PATENT DOCUMENTS 5,839,982 A * 11/1998 Hying ..... A63B 63/083 473/481
5,932,065 A * 8/1999 Mitchell ..... H05K 3/3415 156/382

(Continued)

FOREIGN PATENT DOCUMENTS

DE 38 81 690 T2 12/1993
EP 0671538 A1 * 9/1995 ..... E06B 9/17

(Continued)

*Primary Examiner* — Jeffrey A Shapiro
(74) *Attorney, Agent, or Firm* — Black, McCuskey, Souers & Arbaugh, LPA

(57) ABSTRACT

The invention relates to a device for handling notes of value, comprising a head module and a safe module for accommodating a cash box. Further, the device has an intermediate module for transmitting a drive force of a drive unit of the head module to a cash box mechanism and/or to transport elements of the safe module. The intermediate module is designed such that it is adaptable to at least two different wall thicknesses of a wall of the safe module so that at least for these two wall thicknesses it can transmit the drive force from the drive unit to the cash box mechanism or the transport elements of the safe module.

8 Claims, 5 Drawing Sheets

(51) Int. Cl.

| | |
|---|---|
| ***G07F 19/00*** | (2006.01) |
| ***G07D 11/40*** | (2019.01) |
| ***G07D 11/50*** | (2019.01) |
| ***G07D 11/18*** | (2019.01) |

(56) References Cited

U.S. PATENT DOCUMENTS

| | | | | |
|---|---|---|---|---|
| 8,049,597 | B1 * | 11/2011 | Murakami | G06F 21/32 340/5.1 |
| 8,087,656 | B2 * | 1/2012 | Fujita | G07D 11/0081 271/279 |
| 2001/0027669 | A1 * | 10/2001 | Warmack | E05B 63/0004 70/257 |
| 2002/0092727 | A1 * | 7/2002 | Kato | B65H 29/006 194/302 |
| 2005/0006197 | A1 * | 1/2005 | Wendell | G07D 3/121 194/302 |
| 2008/0290595 | A1 * | 11/2008 | Fujita | G07D 11/0081 271/278 |
| 2011/0128526 | A1 * | 6/2011 | Nireki | G07D 7/12 356/71 |
| 2012/0260702 | A1 * | 10/2012 | Jones | B60B 7/16 70/237 |
| 2013/0247799 | A1 | 9/2013 | Furuichi | |

FOREIGN PATENT DOCUMENTS

| | | | | |
|---|---|---|---|---|
| EP | 2128831 | A1 | 12/2009 | |
| EP | 2151805 | A1 | 2/2010 | |
| WO | WO2012132121 | * | 10/2012 | G07D 11/0084 |

* cited by examiner

DEVICE FOR HANDLING NOTES OF VALUE COMPRISING AN INTERMEDIATE MODULE ADAPTABLE TO THE THICKNESS OF THE SAFE WALL

CROSS-REFERENCE TO RELATED APPLICATIONS

This application claims priority to European patent application EP 14 151 459.6 filed Jan. 16, 2014 which is hereby incorporated by reference in its entirety.

BACKGROUND OF THE INVENTION

The invention relates to a device for handling notes of value, comprising a head module and a safe module in which at least one cash box for holding notes of value can be accommodated. The safe module has a wall in which an opening for passing the notes of value is provided. In the head module, a transport unit for transporting the notes of value to the safe module and/or away from the safe module is provided. Further, a drive unit for driving the transport unit is arranged in the head module.

Many devices for handling notes of value, such as automated teller machines, are divided into a head module and a safe module. The cash boxes in which the notes of value are deposited are arranged in the safe module. By means of the safe module a protection of the cash boxes against unauthorized access shall be achieved. In the head module, on the other hand, all further units required for handling the notes of value are provided. For example, in the head module an input and/or output compartment for the input and/or output of the notes of value, a separating unit for separating notes of value input as a bundle, a stacking unit for stacking notes of value to be output to a value note stack and/or a checking unit for checking the authenticity of notes of value and/or for determining their denomination are arranged.

Further, in the head module, the safe module and the cash boxes accommodated in the safe module transport elements for transporting the notes of value between the individual units and the cash box are provided. For reducing costs and for saving space the automated teller machine normally comprises only one main drive unit which is arranged in the head module and via which a plurality of units can be driven. In particular, the cash boxes do not comprise an own drive unit for the value note transport. In the safe no drive unit is provided either since, for maintenance purposes, access to the safe module would be required, which due to the safety regulations to be met is only allowed according to the four-eyes principle so that always two service employees would be needed. Therefore, the drive force of the drive unit arranged in the head module is transmitted to the cash box mechanism and/or to transport elements in the safe module.

Dependent on the safety required, safe modules with different wall thickness are used. Dependent on the wall thickness, also the mechanism with which the drive force of the drive unit is transmitted to the cash box mechanism or the transport elements has to be designed differently. In known automated teller machines this is accomplished in that corresponding to the safe wall thickness different head modules are used, the drive unit of which is adapted accordingly. This has the disadvantage that for each type of safe module used an own adapted head module has to be used.

Such automated teller machines are, for example, known from document DE 38 81 690 T2.

It is an object of the invention to specify a device for handling notes of value, the structure of which can be easily adapted to different wall thicknesses of a safe module.

According to an embodiment of this invention, the device comprises an intermediate module for transmitting the drive force of the drive unit to the cash box mechanism of a cash box which can be accommodated in the safe module and/or to transport elements of the safe module for the transport of notes of value. The intermediate module is at least in part arranged within the opening in the wall of the safe module and designed such that it is adaptable to at least two different wall thicknesses of the wall of the safe module so that at least in the case of these two wall thicknesses it can transmit the drive force from the drive unit to the cash box mechanism or the transport elements of the safe module.

Thus, the head module is no longer directly coupled to the cash box but an intermediate module is interconnected which can be adapted to different wall thicknesses used. Thus, the head module and the safe module can remain unchanged independent of the wall thickness. By means of the adaptability of the intermediate module it is further achieved that even the intermediate module does not have to be replaced but only adapted to the corresponding wall thickness. Thus, as many different types of the device for handling notes of value as possible can be assembled with as little components as possible so that the production is simplified and costs are saved. Further, this has the advantage that all components subject to wear are easily accessible to the service employees without access to the safe module being required. Thus, maintenance can be carried out by only one service employee since, unlike in the case of the opening in the safe module, no second person is needed for supervision.

The device for handling notes of value is an automated teller machine, an automatic cash register system or an automatic cash safe. Preferably, the device is a mere cash deposit machine, i.e. notes of value can only be deposited in the automated teller machine and cannot be dispensed to a customer again but are stored in cash boxes.

The head module in particular comprises an input compartment for the input of notes of value as well as a checking unit for checking the authenticity of the notes of value and/or for determining their denomination. The transport unit in particular has a plurality of transport elements, such as rollers, by means of which the notes of value can be transported between the input compartment and the safe module.

The cash boxes, which can be accommodated in the safe module, are in particular designed such that they only comprise passive elements, i.e. that inside them there is neither provided a drive unit for driving the cash box mechanism nor a power source. On the other hand, in the head module in particular all active elements required for the device are provided, in particular the drive unit, the electronics and active mechanisms.

The drive unit is in particular an electric motor.

The intermediate module is preferably designed such that it can be adapted to more than two different wall thicknesses. In particular, the intermediate module is designed such that it can be adapted to all used wall thicknesses of the respective production series.

In the safe module, preferably at least one cash box is arranged, the mechanism of which is drivable by means of the drive unit via the intermediate module.

Further, it is advantageous when the head module comprises a first interface for applying the drive force from the drive unit upon the intermediate module. In this case, the cash box has a second interface for applying the drive force from the intermediate module upon the cash box so that the first and the second interface are mechanically connected to each other via the intermediate module so that the intermediate module transmits the drive force generated by the drive unit and transmitted to the intermediate module via the first interface to the cash box mechanism. Alternatively, also the safe module itself can have the second interface so that the drive force is transmitted to transport elements of the safe module. Preferably, the drive force can then also be transmitted from the transport elements to the cash box mechanism.

Dependent on the wall thickness of the safe module, i.e. dependent on the used design of the automated teller machine, the distance between the first and the second interface varies so that a varying distance has to be spanned by the intermediate module. For this, the intermediate module is designed such that in a first state it spans a first distance between the first interface and the second interface and in a second state it spans a second distance between the first interface and the second interface that is different from the first distance. Thus, the intermediate module can be adapted to the wall thickness of the safe module.

The first interface and the second interface preferably each have at least one gear wheel which in particular meshes with a gear wheel of the intermediate module.

In a particularly preferred embodiment, the intermediate module has a chassis with a plurality of mounting elements for mounting gear wheels. In particular, the chassis has a plurality of holes arranged according to a predetermined hole pattern, in which the shafts of the gear wheels can be mounted. The chassis is in particular designed in the form of a metal sheet.

In a first state in which the intermediate module serves to span a first wall thickness a predetermined first number of gear wheels is arranged in holes predetermined for the first state. Accordingly, in a second state which serves to span a second wall thickness via the intermediate module a predetermined second number of gear wheels is arranged in holes predetermined for the second state. Thus, by changing the number, the arrangement and/or the size of the used gear wheels an adaptation of the intermediate module to the wall thickness and thus to the distance to be spanned between the interfaces of the head module and the cash box or the safe module can be accomplished in an easy manner.

In a possible embodiment, the first number and the second number of used gear wheels are different. Thus, by using more gear wheels a greater distance can be spanned in an easy manner.

Further, the holes predetermined for the first state can differ at least in part from the holes predetermined for the second state. In this embodiment, the change of the distance to be spanned is at least in part compensated for in that the gear wheels are at least in part arranged in different holes.

In a further embodiment, at least one different gear wheel having a different diameter can be used in the second state, as compared to the first state. Thus, the varying distance to be spanned caused by the different wall thickness is adapted in that gear wheels with different diameters are used.

The three principles described before, i.e. the change of the number of gear wheels, the change of the pattern in which they are arranged, and the change of the diameter of gear wheels may also be combined with one another in an arbitrary manner so that it is possible to span different wall thicknesses as easy as possible.

Further, also other states can be predetermined in which further wall thicknesses can be spanned. This, too, can for example take place by means of the same above-described principles.

In a particularly preferred embodiment, the number of holes of the chassis is greater than the first number of gear wheels and greater than the second number of gear wheels so that by varying the arrangement of the gear wheels an adaptation to the wall thickness can be accomplished.

In an alternative embodiment, also the first number, the second number and the total number of holes can be identical so that the adaptation is merely accomplished by changing the diameter of the gear wheels used.

The notes of value are transportable within the device in particular along a transport path which is predetermined in the region of the head module at least in part by the transport unit. This transport path is designed such that it runs through the intermediate module at least in part. For this, the intermediate module in particular has own transport elements, such as rollers, for transporting notes of value, which rollers can likewise be driven via the drive unit of the head module. By providing the transport path in the intermediate module, i.e. by passing the notes of value through the intermediate module, a particularly compact structure is achieved so that only a minimum opening in the safe wall is required in which the intermediate module is arranged and through which the notes of value are transported. Thus, the highest possible safety is achieved.

In a particularly preferred embodiment, the intermediate module further has a transmission unit for transmitting a sensor signal between a sensor unit of the head module and a detection unit of the cash box. Thus, it is achieved that not only the drive force can be transmitted between the head module and the cash box via the intermediate module but at the same time also the sensor signals.

The sensor unit of the head module is in particular an active sensor unit for generating an output signal and for receiving an input signal, the detection unit of the cash box or of the safe module merely being a passive unit, i.e. no active signals are generated by it but only the output signal that is sent by the active sensor unit of the head module is changed so that the sensor unit of the head module receives a correspondingly different input signal. Likewise, the transmission unit of the intermediate module is preferably designed as a passive unit.

The transmission unit of the intermediate module in particular comprises an optical fiber via which light emitted by the sensor unit of the head module can be transmitted to the detection unit of the cash box. By means of the sensor unit, the detection unit and the transmission unit in particular at least one light barrier is formed.

BRIEF DESCRIPTION OF THE DRAWINGS

Further features and advantages of the invention result from the following description which explains the invention in more detail on the basis of embodiments in connection with the enclosed Figures.

DETAILED DESCRIPTION OF THE PREFERRED EMBODIMENTS

Figure 1:
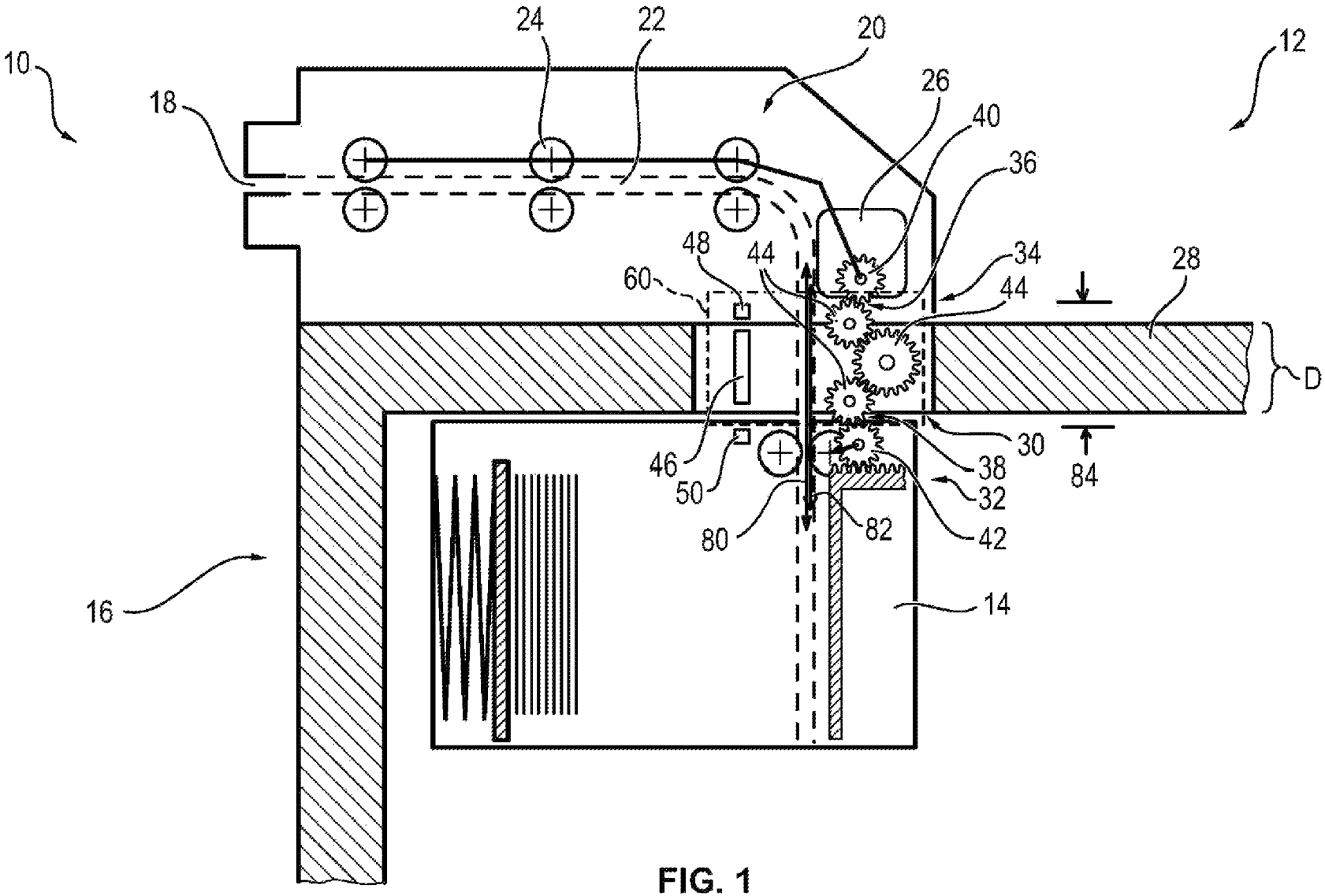
FIG. 1 shows a schematic illustration of a detail of a device for handling notes of value.

In FIG. 1, a schematic illustration of a detail of a device 10 for handling notes of value is illustrated, this device being designed as a cash deposit machine. The device 10 comprises a head module 12 and a safe module 16 in which a cash box 14 for holding notes of value is arranged.

In the head module 12, an input compartment 18 is provided via which a user can input notes of value to be deposited. The input notes of value are transported by means of a transport unit 20 along a transport path 22 to the safe module 16 and thus to the cash box 14 in which they are to be deposited. The transport unit 20 comprises a plurality of rollers for the transport of the notes of value, one of these rollers being identified, for example, with the reference sign 24. Further, in the head module 12 a drive unit 26, for example an electric motor, is arranged by means of which the rollers 24 of the transport unit 20 can be driven. Further, this drive unit 26 preferably also serves to drive transport elements in other non-illustrated units of the head module 12. For example, a checking unit for checking the authenticity and/or the denomination of the input notes of value can be provided in the head module 12.

The safe module 16 has a wall 28 having a wall thickness D. The larger the wall thickness D is designed, i.e. the thicker the wall 28, the safer the safe module 16 and the more the cash boxes 14 accommodated therein are protected. An opening 30 through which the notes of value can be transported between the head module 12 and the safe module 16 is provided in the wall 28. This opening 30 is designed as small as possible so that an unauthorized access to the cash boxes 14 accommodated in the safe module 16 is made as difficult as possible.

The cash box 14 has a cash box mechanism 32 which, for example, likewise serves to transport the notes of value within the cash box 14 and in particular to deposit them in the cash box 14. For example, rollers, retaining elements and stuffing units can be driven thereby.

Here, the cash box mechanism 32 is passively designed, i.e. that within the cash box 14 no own drive unit is provided but the mechanism 32 is likewise driven via the drive unit 26 of the head module 12.

For transmitting the drive force from the drive unit 26 to the cash box mechanism 32 an intermediate module 34 is provided which is at least in part arranged within the opening 30.

The drive unit 26 has a first interface 36 via which the drive force can be transmitted to the intermediate module 34. Accordingly, the cash box 14 has a second interface 38 via which the drive force generated by the drive unit 26 can be transmitted to the cash box 14 from the intermediate module 34. Here, the intermediate module 34 serves to span the distance between this first interface 36 and the second interface 38. In the embodiment shown in FIG. 1, both the first interface 36 and the second interface 38 are each designed as a gear wheel 40, 42 which mesh with gear wheels 44 of the intermediate module 34. As shown in FIG. 1, the exemplary opening 30 extends along and is centered on an exemplary opening axis 80. As also shown in FIG. 1, the exemplary intermediate module 34 also includes an exemplary chasses 60 extending along an exemplary longitudinal axis 82. As also shown in FIG. 1, the exemplary opening axis 80 and the exemplary longitudinal axis 82 extend in the same directions (up and down based on the perspective of FIG. 1). As also shown in FIG. 1, the exemplary gears 44 define a gear train spanning a first length 84 along the longitudinal axis 82, extending from the upper tip of the uppermost shown gear 44 to the lower tip of the lowermost shown gear 44. As also shown in FIG. 1, the exemplary gear train does not extend past the top edge of the chassis 60.

As will be explained in the following in more detail on the basis of specific embodiments in connection with FIGS. 2 to 10, the intermediate module 34 is designed such that it can be adapted to the distance between the first interface 36 and the second interface 38.

Dependent on safety requirements, safe modules 16 with different wall thicknesses D are used. The larger the wall thickness D, the greater the distance between the interfaces 36, 38, i.e. the greater the distance to be spanned by the intermediate module 34.

By using an intermediate module 34 for transmitting the force from the head module 12 to the cash box 14 and by means of its adaptability to the wall thickness D it is achieved that in different devices 10 with different wall thicknesses D the same head module 12 and also the same intermediate module 34 can be used and merely the intermediate module 34 has to be adapted accordingly.

Further, the intermediate module 34 may be designed such that the transport path 22 runs through it so that the opening 30 can be kept as small as possible and a compact, safe structure is achieved. The intermediate module 34 itself can have transport elements for the transport of the notes of value through the intermediate module 34.

In addition, the intermediate module 34 comprises a transmission unit, designed as an optical fiber 46, for transmitting a sensor signal between the head module 12 and the cash box 14. In the head module 12, an active sensor unit 48 is provided which can emit an output signal and receive an input signal. In the cash box 14 a passive detection unit 50 is arranged which, possibly dependent on a detected state, modifies the output signal of the sensor unit 48 of the head module 12 after the same has been transmitted via the optical fiber 46 of the intermediate module 34 and transmits it back to the sensor unit 48 of the head module 12 via the optical filter 46 so that this sensor unit 48 receives a corresponding input signal.

The active sensor unit 48 comprises in particular a light source via which a light beam is injected into the optical fiber 46 and transmitted to the detection unit 50, which, for example, comprises a plurality of assemblies for optical interruption.

Figure 2:
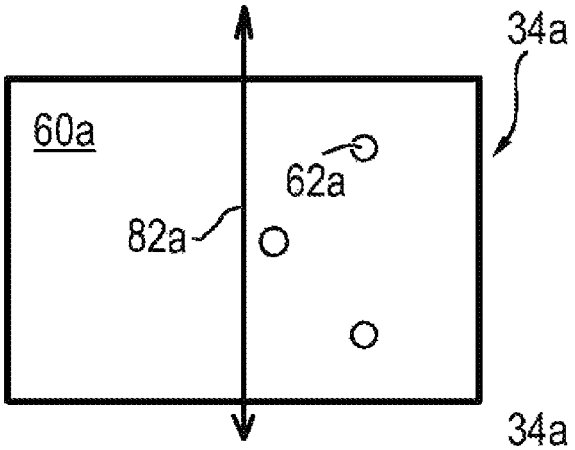
FIG. 2 shows a schematic illustration of a chassis of an intermediate module of the device of FIG. 1 according to a first embodiment.
Figure 3:
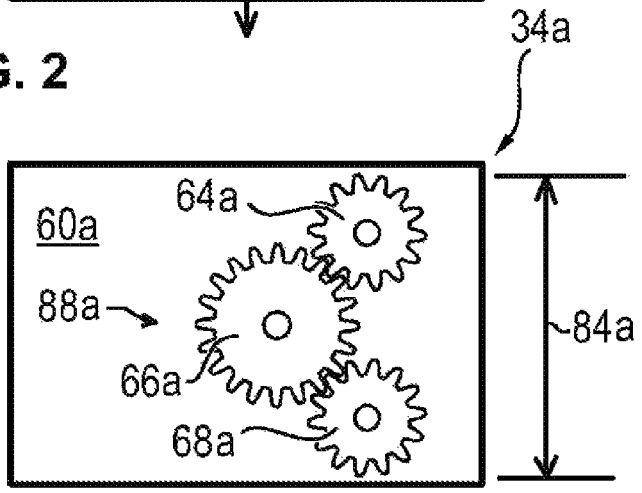
FIG. 3 shows a schematic illustration of a detail of the intermediate module according to the first embodiment of FIG. 2 in a first state.
Figure 4:
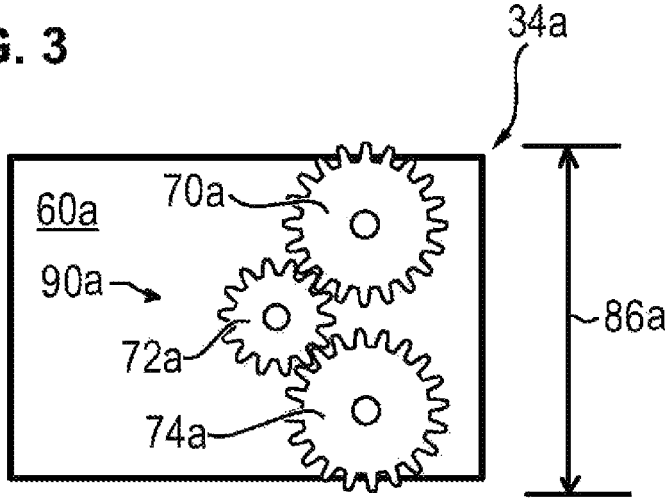
FIG. 4 shows a schematic illustration of a detail of the intermediate module according to the first embodiment of FIG. 2 in a second state.
Figure 5:
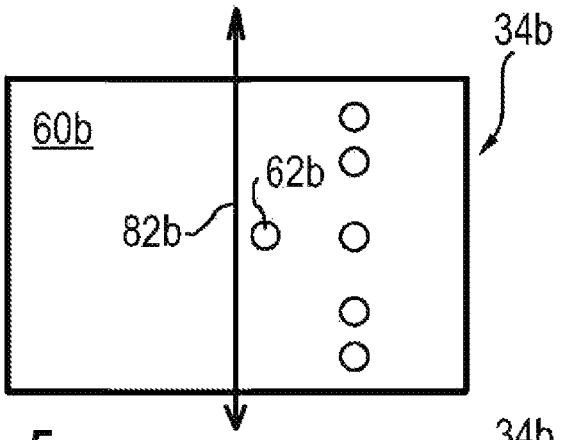
FIG. 5 shows a schematic illustration of a chassis of an intermediate module according to a second embodiment.
Figure 6:
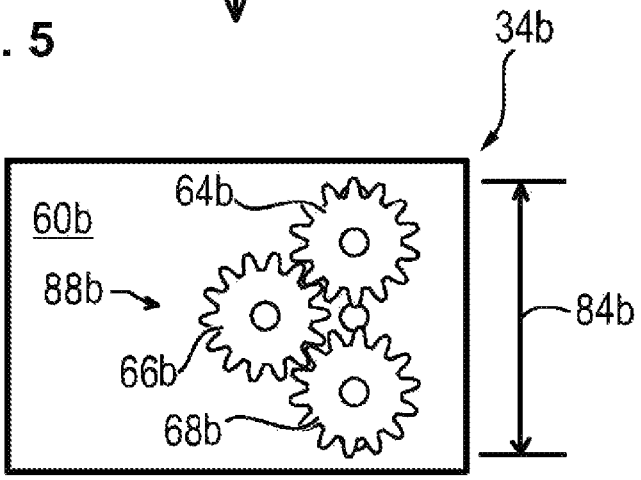
FIG. 6 shows a schematic illustration of a detail of the intermediate module according to the second embodiment of FIG. 5 in a first state.
Figure 7:
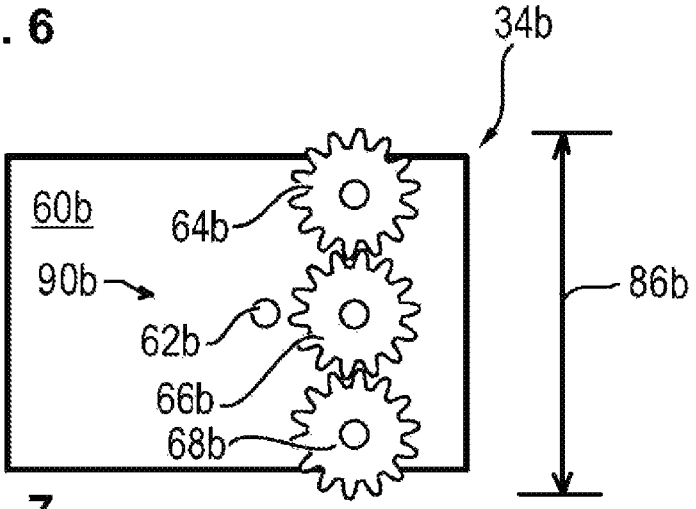
FIG. 7 shows a schematic illustration of a detail of an intermediate module according to the second embodiment of FIG. 5 in a second state.
Figure 8:
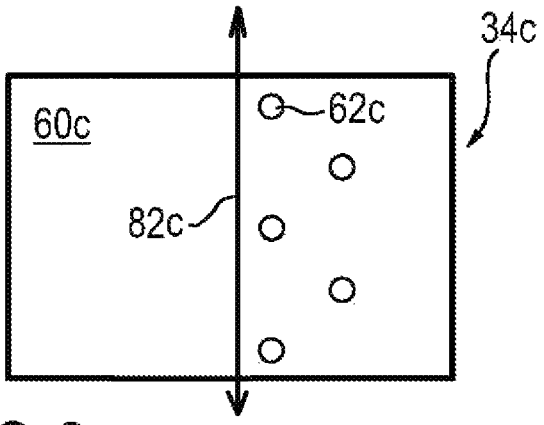
FIG. 8 shows a schematic illustration of a chassis of an intermediate module according to a third embodiment.
Figure 9:
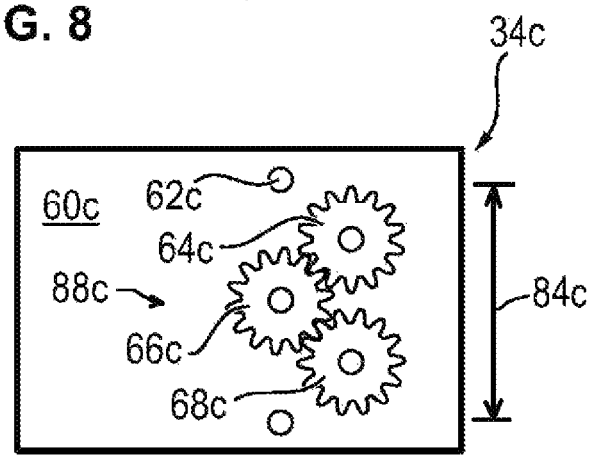
FIG. 9 shows a schematic illustration of a detail of the intermediate module according to the third embodiment of FIG. 8 in a first state.
Figure 10:
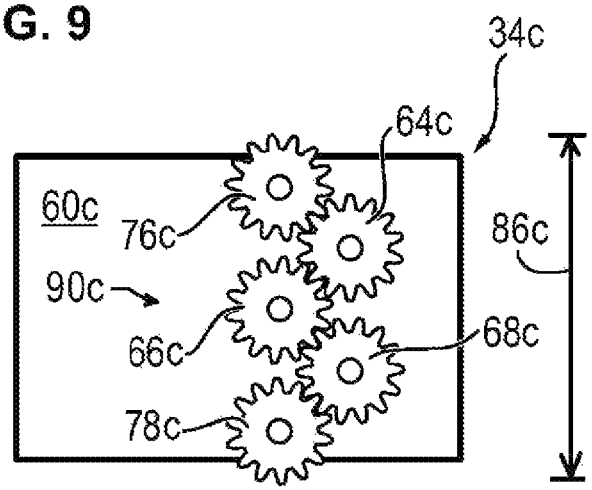
FIG. 10 shows a schematic illustration of a detail of the intermediate module according to the third embodiment of FIG. 8 in a second state.

In the following, several embodiments for intermediate modules 34 in connection with FIGS. 2 to 10 are explained in more detail, FIGS. 2 to 4 showing a first embodiment, FIGS. 5 to 7 showing a second embodiment and FIGS. 8 to 10 showing a third embodiment. In all embodiments, always a first and a second state of the respective intermediate module are described, these two states serving to span different wall thicknesses D. Here, the first state is the state which is used for a small wall thickness D and the second state is the state which is used for a large wall thickness D.

In FIG. 2, a schematic illustration of a chassis 60*a* of an intermediate module 34*a* according to a another embodiment is illustrated. The exemplary chassis 60*a* includes an exemplary longitudinal axis 82*a* and has three holes 62*a*, each of which serves to mount shafts of gear wheels.

In FIG. 3, a schematic illustration of a detail of the intermediate module 34*a* according to the embodiment of FIG. 2 is shown. In this first state, in all three holes 62*a* one shaft each is accepted on which one gear wheel 64*a* to 68*a* each is arranged. As also shown in FIG. 3, the exemplary gears 64*a*, to 66*a*, 68*a* define a first gear train 88*a* having a first gear orientation spanning a first length 84*a* along the longitudinal axis 82*a*, extending from the upper tip of the uppermost shown gear 64*a* to the lower tip of the lowermost shown gear 68*a*. In FIG. 4, a second state of the intermediate module 34*a* is shown, wherein, here too, in all three holes 62*a* one shaft each is accepted on which one gear wheel 70*a* to 74*a* each is arranged, however, the gear wheels 70*a* and 74*a* having a larger diameter than the gear wheels 64*a* and 68*a*, and the gear wheel 72*a* having a smaller diameter than the gear wheel 66*a* so that altogether a greater distance and thus a larger wall thickness D can be spanned. As also shown in FIG. 4, the exemplary gears 70*a*, 72*a*, 74*a* define a second gear train 90*a* having a second gear orientation spanning a second length 86*a* along the longitudinal axis 82*a*, extending from the upper tip of the uppermost shown gear 70*a* to the lower tip of the lowermost shown gear 74*a*. As shown by comparison of FIGS. 3 and 4, the second length 86*a* is greater than the first length 84*a*. As also shown by comparison of FIGS. 3 and 4, the second gear orientation extends across and beyond the chassis 60*a* and the first gear orientation does not extend beyond the chassis 60 *a*.

In FIG. 5, a schematic illustration of a chassis 60*b* of an intermediate module 34*b* according to a another embodiment is illustrated. In this embodiment, the chassis 60*b* has altogether six holes 62*b* for accepting shafts and includes an exemplary longitudinal axis 82*b*. In the first state shown in FIG. 6 here altogether three shafts with each time one gear wheel 64*b* to 68*b* arranged on the shaft are accepted in three of these holes 62*b* so that the gear wheels 64*b* to 68*b* are arranged in a triangle with respect to each other. As also shown in FIG. 6, the exemplary gears 64*b*, 66*b*, 68*b* define a first gear train 88*b* having a first gear orientation spanning a first length 84*b* along the longitudinal axis 84*b*, extending from the upper tip of the uppermost shown gear 64*b* to the lower tip of the lowermost shown gear 68*b*. In the second state illustrated in FIG. 7, the same three gear wheels 64*b* to 68*b* are used. The shafts on which the gear wheels 64*b* to 68*b* are arranged are, however, accepted in the other three holes 62*b* so that they are arranged along a line and thus can span a greater distance. Here, in particular, all three gear wheels 64*b* to 68*b* can be identical in construction. As also shown in FIG. 7, the exemplary gears 64*b*, 66*b*, 68*b* define a second gear train 90*b* having a second gear orientation spanning a second length 86*b* along the longitudinal axis 82*b*, extending from the upper tip of the uppermost shown gear 64*b* to the lower tip of the lowermost shown gear 68*b*. As shown by comparison of FIGS. 6 and 7, the second length 86*b* is greater than the first length 84*b*.As also shown by comparison of FIGS. 6 and 7, the second gear orientation extends across and beyond the chassis 60*b* and the first gear orientation does not extend beyond the chassis 60*b*. In FIG. 8, a schematic illustration of a chassis 60*c* of an intermediate module 34*c* according to a another embodiment is shown, wherein in this third embodiment five holes 62*c* are provided which are arranged in two rows. The exemplary chassis 60*c* includes an exemplary longitudinal axis 82*b*. In the first state shown in FIG. 9, only in three holes shafts with gear wheels 64*c* to 68*c* arranged thereon are accepted. As also shown in FIG. 9, the exemplary gears 64*c*, 66*c*, 68*c* define a first gear train 88*c* having a first gear orientation spanning a first length 84*c* along the longitudinal axis 82*c*, extending from the upper tip of the uppermost shown gear 64*c* to the lower tip of the lowermost shown gear 68*c*. In the second state shown in FIG. 10, in addition in the two remaining outer holes one shaft each with one gear wheel 76*c*, 78*c* each arranged on the shaft is accepted so that now a greater distance can be spanned. As also shown in FIG. 10, the exemplary gears 64*c*, 66*c*, 68*c*, 78*c* define a second gear train 90*c* having a second gear orientation spanning a second length 86*c* along the longitudinal axis 82*c*, extending from the upper tip of the uppermost shown gear 76*c* to the lower tip of the lowermost shown gear 78*c*. As shown by comparison of FIGS. 9 and 10, the second length 86*b* is greater than the first length 84*c*. As also shown by comparison of FIGS. 9 and 10, the second gear orientation extends across and beyond the chassis 60*c* and the first gear orientation does not extend beyond the chassis 60*c*.

Thus, in general the change of the spanned distance, i.e. the adaptation to the wall thickness D, can be accomplished in that the number of gear wheels, the size of the gear wheels and/or the arrangement of the gear wheels are changed. In particular, the different described methods of the three embodiments can also be combined with one another in an arbitrary manner. In addition, by means of these methods also more than two states can be predetermined so that more than two different wall thicknesses D can be spanned by means of the intermediate module 34.

Figure 11:
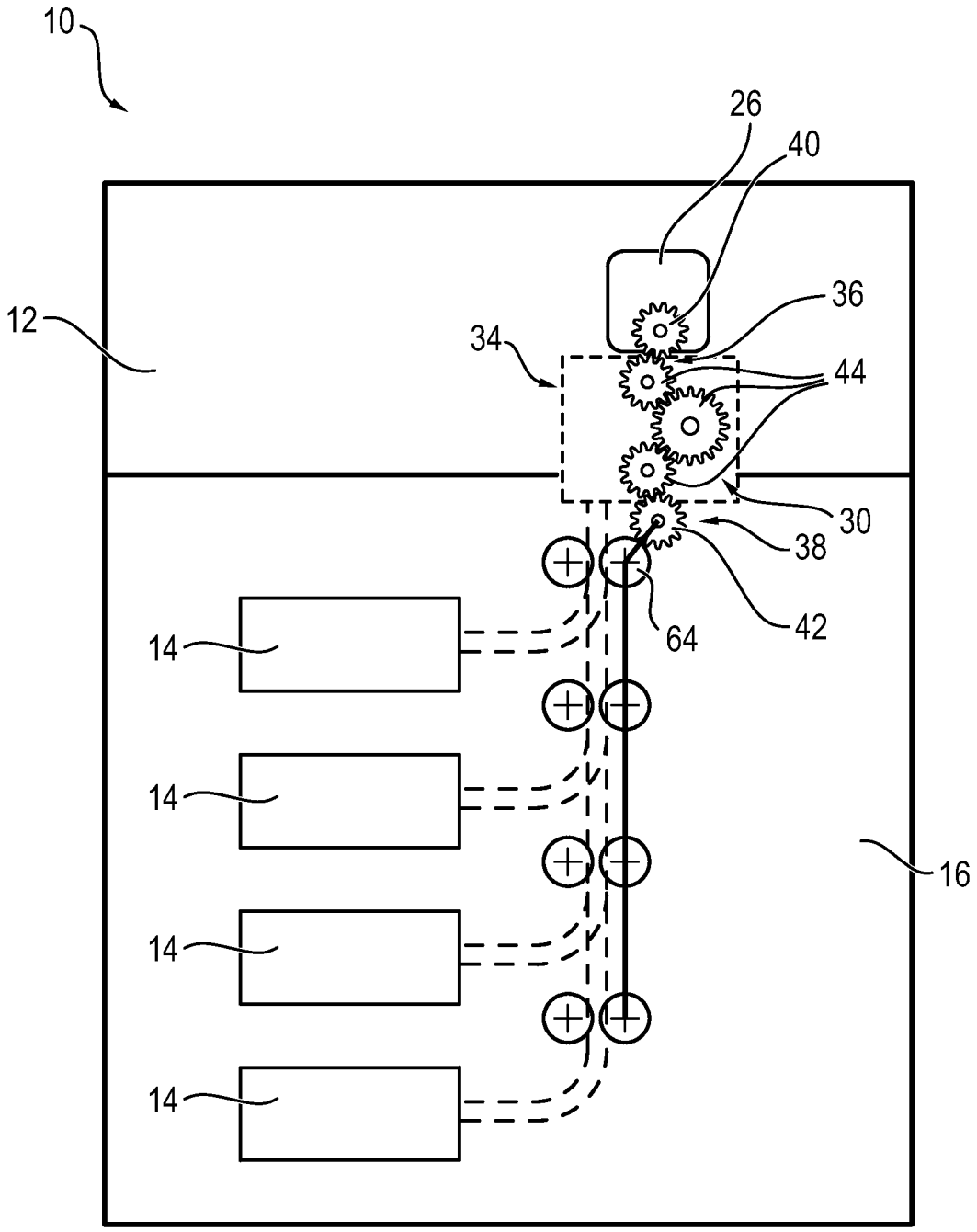
FIG. 11 shows a schematic illustration of a device for handling notes of value according to a further embodiment.

In FIG. 11, a schematic illustration of a device 10 for handling notes of value according to a further embodiment is shown. In this embodiment, the drive force is transmitted via the intermediate module 34 not directly onto the cash box mechanism 32 of the cash box 14 but to transport elements 64 of the safe module 16 which serve to transport notes of value within the safe module 16. This is in particular useful for devices 10 comprising several cash boxes 14.

The intermediate module 34 can in particular be designed in accordance with the afore-mentioned embodiments as intermediate module 34*a*, 34*b* and/or 34*c*.

In a preferred embodiment, the drive force can be transmitted from the transport elements 64 of the safe module 16 also further to the cash box mechanism 32 of the cash boxes 14 so that these, too, can be driven via the drive unit 26.

What is claimed is:

1. A device for handling notes of value, the device comprising:

a head module including a transport unit and a drive unit for driving the transport unit;

a safe module configured to accommodate at least one cash box for storing notes of value, the transport unit configured to transport the notes of value to and from the safe module, the safe module including a wall defining an opening through which the notes of value can pass into and out of the safe module to and from the head module, the opening extending along and centered on an opening axis;

an intermediate module positioned within the opening of the safe, the intermediate module including a plurality of gear wheels and a chassis extending along a longitudinal axis, the opening axis and the longitudinal axis extending in the same directions, the chassis having a plurality of holes wherein each hole of the plurality of holes defines a gear wheel mount, wherein the plurality of holes in the chassis is configured to selectively support two or more of the plurality of gear wheels in at least first and second alternative gear orientations each extending at least partially within the opening of the safe module itself, wherein:

the first gear orientation is defined by a first gear train of at least some of the plurality of gear wheels, each positioned in one of the plurality of holes in the chassis and at least partially within the opening of the safe module, the first gear train spanning a first length along the longitudinal axis, and the second gear orientation is defined by a second gear train of at least some of the plurality of gear wheels, each positioned in one of the plurality of holes in the chassis and at least partially within the opening of the safe module, the second gear train spanning a second length along the longitudinal axis, the second length greater than the first length and wherein the second gear orientation extends across and beyond the chassis along the longitudinal axis and the first gear orientation does not extend beyond the chassis along the longitudinal axis;

a first gear interface of the head module configured to apply drive force generated by the drive unit to the one of the first and second gear orientations that is arranged on the chassis of the intermediate module; and a second gear interface of the safe or the cash box, the second gear interface configured to receive the drive force from the one of the first and second gear orientations that is arranged on the chassis of the intermediate module such that the one of the first and second gear orientations that is arranged on the chassis of the intermediate module mechanically connects the first gear interface to the second gear interface.

2. The device of claim 1 wherein, in the first gear orientation, at least some of the plurality of gear wheels are mounted in different ones of the plurality of holes as compared to the second gear orientation.

3. The device of claim 1 wherein the plurality of gear wheels includes gear wheels sized differently from one another.

4. The device of claim 1 wherein a number of the plurality of holes in the chassis is greater than a number of the plurality of gear wheels.

5. The device of claim 1 wherein a number of the plurality of gear wheels in the first gear train and a number of the plurality of gear wheels in the second gear train are the same.

6. The device of claim 5 wherein the plurality of gear wheels in the first gear train and the plurality of gear wheels in the second gear train are the same size.

7. The device of claim 1 wherein at least one of the plurality of gear wheels of the first gear train is included in the plurality of gear wheels of the second gear train.

8. The device of claim 1 wherein a number of the plurality of gear wheels in the first gear train and a number of the plurality of gear wheels in the second gear train are not the same.

* * * * *